US005697448A

United States Patent [19]

Johnson

[11] Patent Number: 5,697,448

[45] Date of Patent: Dec. 16, 1997

[54] OIL WELL PUMPING MECHANISM PROVIDING WATER REMOVAL WITHOUT LIFTING

[76] Inventor: Gordon Johnson, 2010 Fairwind Rd., Houston, Tex. 77062

[21] Appl. No.: 564,388

[22] Filed: Nov. 29, 1995

[51] Int. Cl.[6] ..... E21B 43/38

[52] U.S. Cl. ..... 166/369; 166/106

[58] Field of Search ..... 166/369, 68, 68.5, 166/105, 105.5, 106

[56] References Cited

U.S. PATENT DOCUMENTS

| | | | |
|---|---|---|---|
| 4,296,810 | 10/1981 | Price | 166/106 X |
| 4,469,170 | 9/1984 | Farmer, Jr. | 166/65.1 X |
| 4,766,957 | 8/1988 | McIntyre | 166/265 |
| 5,099,920 | 3/1992 | Warburton et al. | 166/64 X |
| 5,497,832 | 3/1996 | Stuebinger et al. | 166/369 |

*Primary Examiner*—William P. Neuder
*Attorney, Agent, or Firm*—Gunn & Associates, P.C.

[57] ABSTRACT

A pumping apparatus is set forth for use in a flowing well which flows into the well from formations on the exterior thereby producing a mix of oil and water. A column is accumulated where oil stratifies on the top. An oil producing pump is positioned to draw from the top portions of the column and produce oil to the surface through a production tubing string in response to operation of a sucker rod actuated pump. The sucker rod string in addition operates a water expelling pump on the opposite stroke, thereby forcing water out of the accumulated column of liquid. The water is returned from the cased well into a water receiving formation on the exterior.

9 Claims, 2 Drawing Sheets

OIL WELL PUMPING MECHANISM PROVIDING WATER REMOVAL WITHOUT LIFTING

BACKGROUND OF THE DISCLOSURE

It is customary to produce an oil well by pumping, typically using a surface located pump jack which operates a string of sucker rods connected to a downhole pump. Lifting costs are the costs associated with recovery of the produced oil from a well. Of course, a portion of this is the capital cost for equipment which is depreciated over the life of the well. In addition however, there is also a lifting cost which is primarily the cost of electric utilities. In the ordinary case, an electric motor operates the walking beam pump located at the surface. The walking beam supports a string of sucker rods which extend from the surface to a pump which is located in a standing column of liquid recovered from the well. The lifting cost is primarily the utility costs required to lift each gallon of produced liquid. If the well if 10,000 feet deep, the lifting cost requires a specified mount of electrical energy to lift one gallon of liquid across the 10,000 feet to deliver it to the surface. This can be substantial. It can still be substantial even where the well is relatively shallow. While wells can be as shallow as a few hundred feet, the lifting cost is reduced somewhat. In instances, however, where the depth is great, the lifting costs includes a substantial outlay just for the utility expenditures to operate the pump. In some instances, the pump may be operated using readily available natural gas from the well. Even then, the lifting cost is not free.

As considered further, the present disclosure also has an aspect which protects the formation in a greater way. Ordinarily when a formation is first drilled, there is a large, rapid rush as the formation pressure is relieved. Pressure relief arises from removal of natural gas, oil or water sometimes in combination from the formation. Because of differences in density, the natural gas will accumulate at the top of the formation while water will be at the bottom. When the well is first drilled into the formation, production depends on the point of entry. If precisely at the top of the formation, natural gas may be produced but no water. If drilled to the bottom or if drilled entirely through the formation with perforations set to the bottom, the pressure drive may produce only oil or water or a mix from the bottom of the formation. As will be understood, it is not uncommon to produce some water, and perhaps a substantial ratio of water to oil. It has been known to produce as much as ten barrels of water for every barrel of oil. It has been known to produce a favorable ratio of oil to water at the beginning which ratio changes over the life of the well. As the well becomes older, it tends to produce more water. While new, assume the well produces water at a ratio of 1:1; that can readily decline to a ratio of 10:1. When this much water is produced, the lifting costs severely go up. In the example just given, the lifting costs will go up five fold or more to produce one barrel of oil.

After the oil and water has been produced to the surface, there is the consequential problem of disposing of the salt water. The salt water must be properly disposed of. It cannot be poured on the ground or in fresh water rivers. It must be put back into an injection well. Injection wells deliver the salt water back into salt water formations underground. Sometimes, that requires trucking or other disposal.

The production rate can be increased, and one approach in doing this is to inject salt water so the level of water in the formation is raised or at least does not rapidly decline during the life of the producing well.

The present disclosure sets forth a single tubing string completion mechanism which includes serially connected pumps. The upper pump is used in pumping oil which is lifted to the surface in the tubing string. The sucker rod string is positioned in the tubing string to execute this lifting. In addition, there is a second pump which is located below a packer defining the produced zone. It is used to reinject water back into the formation or a formation below the producing strata. This is accomplished by operating the upper pump to lift oil on the upstroke. On the downstroke, the sucker rod string is pushed downwardly by the column of liquid in the tubing string, and the downstroke operates the second pump. It is constructed with inlet and outlet checkvalves so it pumps only water. Water is separated from oil in the casing, that being accomplished by locating the upper or oil pump between two packers which isolate a production zone and installing a third packer to define an injection zone. The injection zone can be located immediately below the production zone or can be located in a strata deeper in the well. The flow routes of the present disclosure will become more readily apparent on a discussion and description of the present system.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

DETAILED DESCRIPTION OF THE PREFERRED EMBODIMENT

Figure 1:
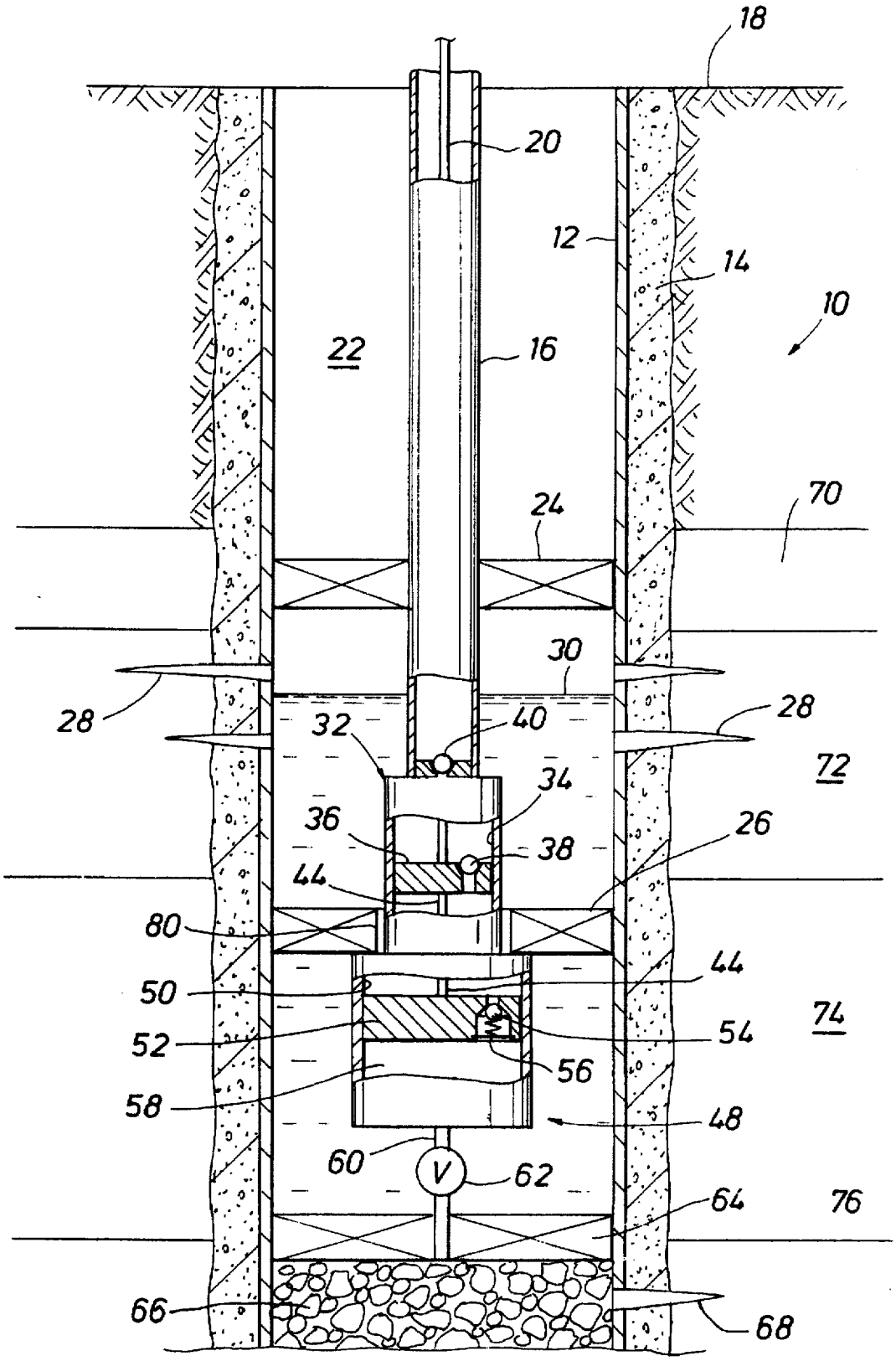
FIG. 1 is a sectional view through a producing well in which a casing is cemented in place, a tubing string surrounds a sucker rod string to provide motive power to an upper pump which incorporates checkvalves so a column of liquid is lifted by the upper pump and wherein the lower pump is used to inject excessive quantities of water back into a disposal strata.

Going now to FIG. 1 of the drawings, the numeral 10 identifies generally the pumping equipment installed in the well borehole of the present disclosure. More specifically, the completed well incorporates a casing 12 which is held in position by an injected sheath of cement 14. The cement prevents leakage on the exterior of the casing. The casing 12 is typically several thousand feet in depth. The casing surrounding a tubing string 16. On the interior, the tubing string encloses a string of sucker rods which are connected with a suitable pumping mechanism which imparts reciprocating motion. The motion at the surface is imparted by a pump jack installed at the surface 18. The pump jack operates the sucker rod string 20 which extends in the well borehole on the interior of the tubing string 16. Typical but not mandated sizes involve a sucker rod which is typically about one half to one inch in diameter, a production tubing string which has a nominal size of two and three eighths or two and seven eighths and a surrounding casing which is typically greater than five inches, typically around seven to nine inches. This provides an annular space 22 on the exterior of the tubing. This is divided by an upper packer 24.

The packer 24 cooperates with the spaced packer 26. The two packers are spaced so produced oil and water is accumulated between the two packers. The bottom packer typically has some sort of landing nipple which enables the bottom packer to properly hook to or connect to the pump which will be described. The two packers define a zone which is able to accumulate a standing column of liquid. Liquid is shown extending up to the level 30. The liquid is produced into this portion of the cased well below the packer 24 and above the packer 26. The produced liquid is input through the perforations 28 which are located at spaced locations along the casing 12.

The sucker rod string has been omitted from portions of FIG. 1 for sake of clarity. The sucker rod string is connected to operate an oil pump, sometimes referred to as the upper pump, the pump being identified with the numeral 32. There is a lower pump which will sometimes be described as the water pump. The water pump is connected in a common housing with the upper or oil pump. The two are anchored on the common packer 26, and the packer 26 serves the purpose of dividing upper and lower chambers for different purposes to be described. In addition, the packer serves as a landing nipple to fasten or anchor the oil pump 32.

The pump 32 incorporates a pump cylinder 34 which encloses a piston 36. The piston 36 is stroked by the sucker rod string 20. The piston 36 raises the column of oil. Produced oil along with water accumulates to the height 30 shown in FIG. 1. Oil is delivered through an opening into the pump 32 (not shown) and fills the cylinder 34. Oil is first collected in the lower portions below the piston 36. On the down stroke of the piston 36 a checkvalve 38 is opened. The valve 38 delivers oil in the cylinder 34 above the piston 36. This is the upper chamber. The checkvalve 38 operates on the downstroke to enable filling above the piston. The piston 36 on the upstroke forces oil out of the cylinder 34 up into the tubing 16 through the standing valve 40. The valves 38 and 40 are checkvalves. They are biased so oil is forced into the tubing string 16. This forms a standing column of liquid. The liquid is pumped to the surface. With each stroke, the liquid is raised so it is produced at the top while additional liquid is forced into the tubing string 16 on the downstroke. All of this occurs under the urging of the sucker rod string 20A which is reciprocated from the surface. In that sense, the operation of the illustrated oil pump is typical with that known heretofore. That is, movement of the piston operates the checkvalves 38 and 40 to lift oil in the column thereby defining a production column.

One added aspect of the present disclosure is the incorporation of the water pump therebelow. The sucker rod 20 discussed with regard to the tubing string 16 is extended by a push rod which is an extension thereof. This extension is identified by the numeral 44. The sucker rod extension 44 extends from the upper or oil pump to the water pump 48 below. The water pump 48 has a cylinder 50 which encloses a piston 52. The piston 52 is reciprocated by the sucker rod string. The water pump diameter is defined by the cylinder 50 in comparison with cylinder 34 on the upper or oil pump. The diameter is increased to alter the ratio of pumping. This ratio is altered so different production ratios from the formation can be accommodated. An explanation will follow.

The water pump 48 is powered by the rod 44 which connects with the piston 52 to reciprocate the piston. The piston incorporates a checkvalve 54. The checkvalve is spring loaded by a spring 56 to close against gravity. On the downstroke, the checkvalve is closed while the upstroke opens the checkvalve. This enables the cylinder 50 to be filled in the lower chamber 58. That chamber is connected with an outlet line 60 which connects through a second checkvalve 62. Line 60 passes through a lower packer 64. That in turn defines a packer isolated zone which is gravel packed by the gravel 66. There are perforations, one or more, 68 which deliver water back into the formation as will be described.

On the outside of the well, assume for purposes of discussion that the adjacent strata includes an impervious strata 70 which is above a producing strata 72. Assume additionally there are other strata 74 therebelow. This can be one or more formations. Assume also the strata 76 is a salt water strata. These will be used in an example of the operation of the well. Assume for purposes of description the producing strata 72 initially produces oil and water in a desirable ratio of 1:1. It is accumulated in the casing to the level 30. The oil pump is operated to lift a column of oil and some water in the production tubing string 16. The produced water and oil is lifted to the surface at a particular cost. Most pumped wells operate in this fashion. The amount of water actually pumped and the amount of oil actually recovered is in part dependent on the pumping rate. That in turn is best made dependent on the production rate and the rate at which the well might be damaged should it be pumped excessively. Generally speaking, the formation produces continuously. The formation fluids are delivered through the perforations 28 and accumulate to some height. Considering a twenty four hour cycle of operation, the well is produced for twenty four hours assuming back pressure does not block production. The oil pump 32 is operated for an interval sufficient to pump off most of the produced oil. Indeed, it is operated for an interval selected so the accumulation of liquid during the twenty four hours is substantially pumped to the surface. If the production rate is ten barrels per day of oil and ten barrels of water, then approximately twenty barrels are pumped to the surface. This continues indefinitely. This may require that pumping occur in one or more operational cycles in a day. Each operation involves switching on and then switching off the prime mover which operates the pump. It may be necessary to operate the pump at a slow rate for twenty four hours, or it may be more desirable to operate the pump three or four different times during the day so that the rate that liquid lifted to the surface is changed. In any case, the pumping rate typically removes about the same amount of liquid which is produced during the twenty four hour interval.

As the formation is depleted, formation pressure is reduced. Generally speaking, formation pressure is determined in part because of the overburden at the formation 70 which is resting on the producing formation. This overburden at least provides some pressure to the fluids which are in the formation 72 and which migrate through the perforations 28 into the annular space within the cased well. Ultimately, there will be a loss of pressure drive in the formation 72 and the pressure will drop. Typically, this is accompanied by production of more water and less oil. The ratio can easily drift from 1:1 to perhaps 10:1 water to oil. As the production rate changes, oil is lifted at the cost of lifting more water and utility costs go higher and higher. Also, the fluid drive in the formation is lost and formation recovery is reduced. It is desirable at this point to inject water back into the formation 72.

The present system provides such a structure. It is, however, as illustrated, installed for returning salt water to another formation. Of course, the formation 76 may be communicated with the formation 72 depending on the geology in the region. In any event, as the accumulated liquid 30 in the casing is lifted, and as the amount of recovered water increases, thereby changing the ratio, it is desirable to leave as much of the water as possible in the downhole location and indeed to return some, hopefully all of the water to the formation.

Considering now the structure of FIG. 1, the upstroke lifts oil to the surface in the tubing string. On the downstroke, some liquid accumulated between the packers 24 and 26 is pumped downwardly through the small passages 80. Water is delivered below into the water pump 48 which fills the cylinder 50 above the piston 52. Filling occurs on the downstroke. On the upstroke of the piston 52, the checkvalve 54 is forced open against the bias spring and water is pumped downwardly. On the downstroke, water is forced through the checkvalve 62 and into the formation 76.

Consider the following examples of operation. When first drilled, assume the bottomhole pressure at the formation is 2,500 psi and it drops to 1,000 psi after substantial production. In that interval, assume further that the water drive begins to flood the perforations 28 and more water is produced than desirable. Assume further that the water and oil accumulate to the height 30 shown around the piston pump. As the column of liquid accumulated in the casing grows, water settles and the oil goes to the top. If produced into the space between the packers 24 and 26 and permitted to stagnate, it will stratify so the oil floats on the surface and the water is on the bottom. Assume that some measure of separation occurs, i.e., the oil tends to rise substantially even though it may still be frothed in the collected column. As long as the well is not pumped, the accumulation of liquid will rise to the height 30 shown in the drawings. When the pump is switched on and reciprocated by providing electrical power for its operation, the oil pump 32 collects oil from near the top of the column 30 and deliver it into the tubing string. While it is possible that some water will be produced with the oil, a recovered stream is then made available. The upstroke therefore pumps from the top portions of the column of liquid 30. The column does stratify as noted and such pumping enable pumping of salt water back into the adjacent formations. As mentioned, the passages 80 deliver liquid off the bottom of the column 30 into the water pump which is then operated to force water back into the formations near the well.

There may be some sand. Sand is removed from the bottom of column 30 through the passages 80 flowing downwardly. It flows downwardly through the checkvalves 54 and 62. It is caught in the serpentine passages of the gravel pack 66. By and large, the sand is collected there while the recovered water is delivered back into the perforation 68 into the zone 76.

As mentioned with regard to the example, assume the formation 72 starts at 2,500 psi but sags to 1,000 psi. Assume also the formation 76 is anywhere between 1,000 psi and 4,000 psi. On the downstroke of the sucker rod string, the oil pump piston has substantial weight on it and is forced downwardly. Note the two pumps arranged serially have individual pistons in them so they move jointly and downwardly as a unit. This continues the pumping cycle.

Assume for purposes of description that the formation 76 is independent of the formation 72. In that instance, salt water is not lifted to the surface and is injected into this disposal formation. On the other hand, the formation 72 may communicate with the formation 76, or indeed, they can be the same formation. In the latter instance, the perforations 68 deliver recycled salt water back into the formation to increase the water drive of the formation and thereby increase the rate of recovery or decrease the rate of pressure decline in the formation 72. Both are desirable benefits of this pumping cycle.

Figure 2:
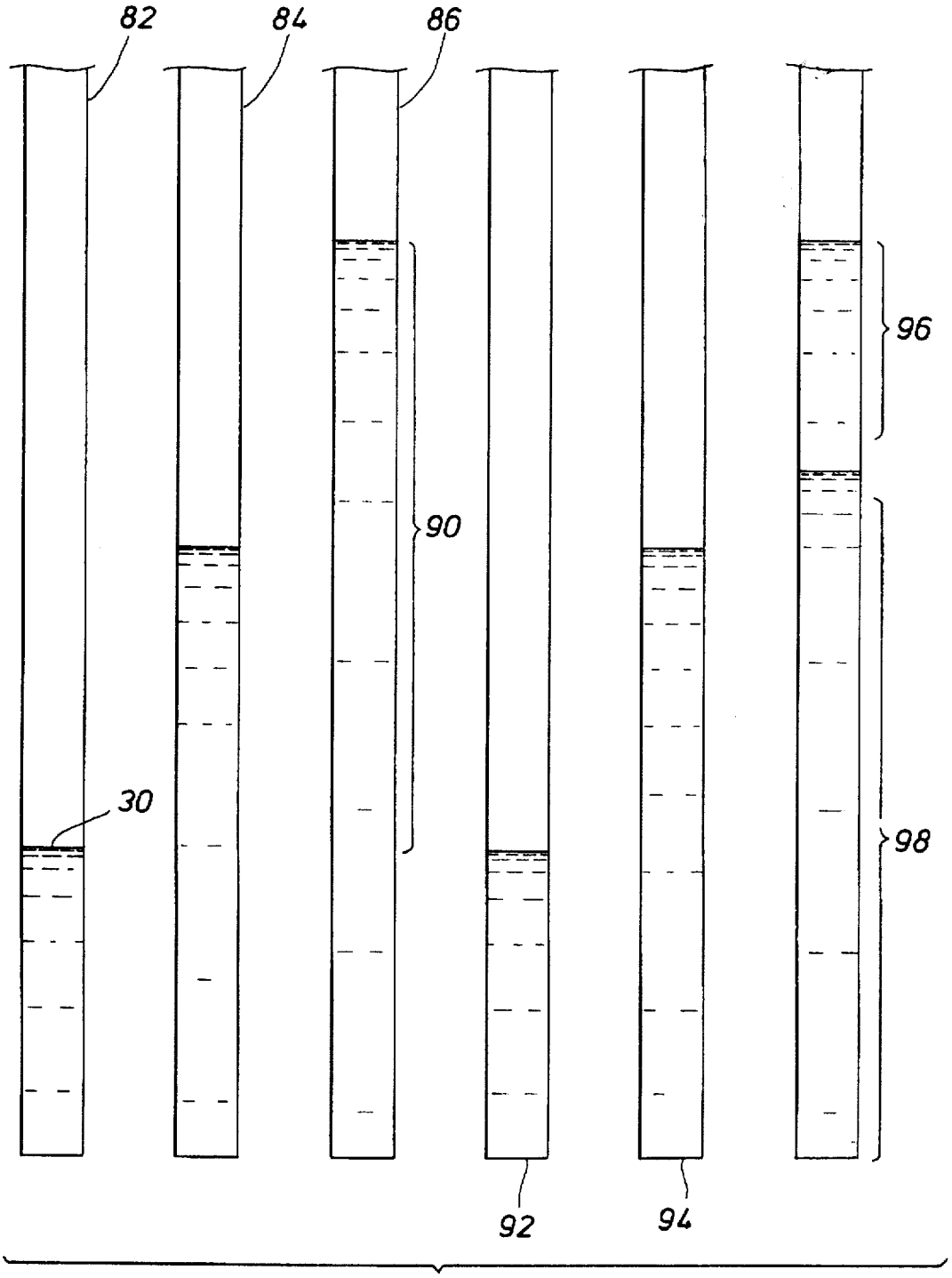
FIG. 2 is a view showing different levels of liquid accumulation at the pump in sequence, and further showing how the two pumps cooperate to remove a significant portion of the produced water which is returned to an injection formation.

Going now to FIG. 2 of the drawings, assume the accumulated column 30 is collected to the level shown in the representation 82. Assume this amount of liquid is recovered in eight hours. After sixteen hours, liquid accumulates to the height depicted at 84. After twenty four hours, it is raised to the height depicted at 86. The system is then operated to remove approximately the production volume obtained in one day which is represented graphically at 90 which is then pumped to the surface through the tubing string. Compare now what might occur using both pumps, namely, the oil pump 32 which pumps up the tubing string 16 and the salt water pump 48. Again, the produced liquid is accumulated as shown at 92 and then accumulated for a greater interval and collects to the height 94. The oil pump pumps the bracketed portion of produced and accumulated liquid identified at 96 while the water pump removes the accumulated liquid column at 98. In this particular instance, assume for purposes of discussion that the oil pump 32 delivers one unit of oil while the salt water injection pump delivers approximately four times greater quantities of produced salt water.

Continuing with FIG. 2 of the drawings, the portion of the standing column of liquid represented by the bracket 96 is delivered to the surface. It is the only portion that must be lifted. That liquid portion represented by the bracket 98 is pumped down without being pumped to the surface. It is simply returned to the adjacent formations as required for safe disposal. To the extent it is pumped back into the formation that provides the production, formation pressure can be kept at the requisite level. The two pumps have pistons which control the pumped volume dependent on piston area. If the two pistons are equal in area, then pumped water and oil have a ratio of 1:1. If the piston 52 is twice the diameter of the piston 36, then the pumped water to oil ratio will be 4:1. Importantly, the water need not be pumped to the surface. Lifting cost is reduced.

Summarizing what is described in this system, the system is a way of pumping on the upstroke to lift oil and pumping on the downstroke to force water back into the formation. It is ideally accomplished with checkvalve operated pumps. Note the two checkvalves associated with the oil pump are biased in a common direction while the two checkvalves associated with the water pump 48 are biased in the opposite direction. This enable recovery of pumping power on both the upstroke and the return stroke.

While the foregoing is directed to the preferred embodiment, the scope thereof is determined by the claims which follow.

What is claimed is:

1. A well pumping apparatus which comprises:

(a) an oil pump adapted to be supported at a selected depth in a well wherein the oil pump comprises:

(1) an upper check valve enabling a column of pumped liquid to be lifted to the surface from the oil pump through a production tubing string;

(2) a traveling plunger;

(4) an elongate sucker rod connecting from said plunger to the surface through the production tubing string;

(e) an opening delivering the top portion of a column of liquid into said chamber; and (6) a lower valve on said plunger;

(b) a packer around said oil pump defining an upstanding liquid column in a cased well around said chamber;

(c) a water pump supported below said packer and said oil pump wherein the water pump comprises:

(1) a first valve within said pump to admit liquid from the bottom of the column of liquid accumulated within the well above said packer;

(2) a second valve;

(3) a piston in a cylinder;

(4) a rod connected from said piston to be moved by said sucker rod so reciprocation of the piston draws liquid from the bottom the column through the piston and forces the liquid out of the water pump;

(d) a water line extending through from said water pump and casing in the well into a formation on the exterior of the casing to provide a water outlet path into the formation so water pumped by the water pump from the column of liquid in the well is forced into a formation on the exterior of the well.

2. The apparatus of claim 1 wherein said packer in the cased well supports said oil pump above said packer at a specified depth in the well and wherein said oil pump is at least partially submerged in the column of liquid accumulated in said oil well; and including a passage through said packer below said oil pump and opening into said water pump to deliver accumulated liquid into said water pump so that the liquid accumulated therein may be pumped from the well by said water pump.

3. The apparatus of claim 1 wherein said oil pump comprises a piston movable on a sucker rod string extending to the surface along said lower production tubing string, and wherein said piston supports said lower valve, and further positioning said upper valve in said production tubing string to enable a column of oil to be lifted to the surface in said production tubing string.

4. The apparatus of claim 1 wherein said oil pump comprises a piston within a surrounding cylinder defining upper and lower chambers therein and said piston incorporates said lower valve therein to control flow of oil between said chambers during pumping by stroking said piston.

5. The apparatus of claim 4 wherein said water pump chamber comprises a cylinder surrounding said water pump piston, and said cylinder has upper and lower chambers separated by said piston therein, and further including a water passage flowing from the lower of said cylinder into said formation and comprising a portion of said flow line.

6. The apparatus of claim 5 wherein said packer supporting said oil pump and water pump enables said pumps to be installed as a unit, and further wherein said water pump is concentric with and aligned below said oil pump and both of said pumps are operated solely by said sucker rod string extending along said production tubing string.

7. The apparatus of claim 1 wherein said water pump has an inlet through said packer and into said water pump cylinder.

8. The apparatus of claim 7 wherein said inlet passes through said packer and into said cylinder above said water pump piston.

9. The apparatus of claim 8 wherein said water pump is mounted below said packer.

* * * * *